United States Patent [19]

Takata et al.

[11] Patent Number: 4,901,705

[45] Date of Patent: Feb. 20, 1990

[54] GAS COMBUSTION APPARATUS

[75] Inventors: Manabu Takata, Yamatokoriyama; Junzo Tanaka, Fujiidera; Yoshiharu Shimada, Kitakatsuragi; Yoshiteru Kagomoto, Kashihara, all of Japan

[73] Assignee: Matsushita Electric Industrial Co., Ltd., Osaka, Japan

[21] Appl. No.: 218,295

[22] Filed: Jul. 13, 1988

[30] Foreign Application Priority Data

Jul. 13, 1987 [JP] Japan ..... 62-174101
Apr. 4, 1988 [JP] Japan ..... 63-97080

[51] Int. Cl.[4] ..... F24C 3/00

[52] U.S. Cl. ..... 126/41 R; 126/21 A; 126/273 R; 126/19 R; 431/252

[58] Field of Search ..... 126/41 R, 39 C, 21 A, 126/19, 273 R, 273 A; 431/252, 286

[56] References Cited

U.S. PATENT DOCUMENTS 973,498 10/1910 Geurink ..... 431/286
2,607,405 8/1952 Weinandy ..... 431/286
2,794,497 6/1957 Dufault et al. ..... 126/41
3,077,826 2/1963 Sikora ..... 126/39 C
3,090,373 5/1963 Yagley et al. ..... 126/41
3,312,271 4/1967 Beach et al. ..... 126/273 R
3,340,794 9/1967 Giuliano ..... 99/443 R
3,682,156 8/1972 Perl ..... 126/21 A

FOREIGN PATENT DOCUMENTS 0200626 11/1986 European Pat. Off. .

*Primary Examiner*—Carroll B. Dority
*Attorney, Agent, or Firm*—Wenderoth, Lind & Ponack

[57] ABSTRACT

A gas heating cooker to be used as a grill or an oven, wherein the blow-off air current of the blowing apparatus blows along the flames of the lower burner to get the hot current to reach far, so that the heating chamber becomes superwide enough to allow a lot of cooking, with the result that the heating operation may be effected with uniform heat distribution in the full face of the heating chamber, and a superior cooking property from even cooking is provided.

6 Claims, 9 Drawing Sheets

83
83
84
85
(81)
85
(81)
82
17

19

113
114
115
(111)
115
(111)
112
18

73
(79)
72
(75)
71

74

77
(79)
76
78

GAS COMBUSTION APPARATUS

BACKGROUND OF THE INVENTION

1. Field of the Invention

The present invention relates to a gas combustion apparatus using gas fuel or a gas heating cooker to be applied to a grill to be engaged wth a gas range by the use of the gas combustion apparatus, or to a grill/oven as a box-type cooker.

2. Description of the Prior Art

Generally, the conventional gas combustion apparatus and the gas heating cooker of this type has two ranges 2 on the top face of the main body 1 and a grill 3 having a door in a gas range as shown in, for example, FIG. 12. Also, in addition, a grill/oven is put into practical use as a box-type cooker. As the system of the grill 3, as shown in (a) in FIG. 13, there is a single-face toasting grill which heats the top face of the cooked food 5 placed on the toasting net 6 by the upper burner 7 with the ceramic perforated plate, wire guaze or punched plate, engaged near the ceiling of the heating chamber 4, as a combustion plate, as shown in (b) in FIG. 14, a toasting net 6 for having the cooked food 5 thereon is provided at the upper, lower central portions of the heating chamber 4, an upper burner 7 which is similar to one of the single-face toasting system is engaged with the ceiling portion of the heating chamber 4, a lower burner which forms in the horizontal direction the Bunson-type flame is engaged on both the sides of the lower portion, with a both-face toasting grill being provided to simultaneously heat both the upper, lower faces of the cooked 5 by each of these burners.

A stock saucer 9 receives oil stock or the like falling from the cooked 5. It is filled with water 10 so that the fallen oil may not be evaporated and burned.

In the single-face toasting grill shown in FIG. 13, the cooked food 5 is heated on the top face with the radiation heat from the upper burner 7, is turned over after the lapse of the given time to heat the other face, with the result that a longer time is taken and the bother of turning over the cooked food is required.

In the double-face toasting grill shown in FIG. 14, both the upper and lower faces of the cooked food 5 are simultaneously heated respectively by the upper burner 7 and the lower burner 8. However, as the lower burner 8 is located on both sides of the lower portion of the heating chamber 4, the combustion of the respective right, left lower burners 8 can not reach the central portion and directs halfway in the upper direction. This is because the draft force of the combustion gas is stronger than the jetting force (which changes slightly depending upon the gas pressure) of the lower burner 8. The raised position becomes a heating position. Accordingly, a portion where the combustion gas directed in the upper direction hits the toasting net 6 becomes maximum at temperature, and the temperature of the central portion, the temperature of both the end portions becomes lower, and the temperature distribution of the toasting net 6 portion at the combustion of the lower burner 8 becomes as shown in FIG. 15. As a result, only double-face toasting grill of inferior temperature distribution is provided, extremely uneven toasting is caused on the lower face of the cooked food 5, thus resulting in inferior cooking.

Accordingly, although the toasting is of double-face the, it is necessary to turn over the cooked food 5 during the cooking operation or to replace the position in order to prevent uneven toasting, thus lowering the value of double-face toasting.

Also, so as to get the combustion gas to reach the central portion of the toasting net 6, the width L of the heating chamber 4 has to be made about 15 cm or lower, so that the amount of the food to be cooked to be toasted at one time becomes extremely small. As the interval between the lower burner 8 and the toasting net 6 is required to be made larger, with the result that the main body becomes larger in size and the thermal efficiency becomes inferior. The lower burner 8 cannot be arranged immediately under the cooked food 5, because the oil stock falls onto the high temperature portion of the lower burner 8 from the cooked food 5 so as to be ignited or cause a lot of oil smoke. Or it cannot be put into practical use, because it is difficult to put in an out the food so as to clean the case 4' of the heating chamber 4 considering the construction.

As shown in FIG. 16, the upper burner 7 and the lower burner 8 of FIG. 14 are composed of a pair of right, left burners. An ignition unit *7u* of the ignition plug *7c*, a firing burner *7d*, a firing detector *7e* is mounted on each of the upper, lower burners 7, 8 so that the construction becomes more complicated and higher at cost. The ignition unit *7u* is engaged only with the single side of a pair of right, left burners of the upper, lower burners 7, 8. The pair of right, left burners may be simultaneously ignited with the length of the flame of the firing burner *7d*, but the first is gone out if the ignition is confirmed. If the burners *7a* and *8a* are blown out on the side where the apparatus of the ignition detector *7e* does not exist during the combustion, there is a risk of the raw gas being released without the flame transfer from the burners *7b* and *8b* on the engagement side of the ignition detector *7e*. Reference character *7f* is an exhaust port, reference characters *7g*, *8g* are gas supply pipes to the upper and lower burners.

SUMMARY OF THE INVENTION

Accordingly, an object of the present invention is to provide a gas combustion apparatus or a gas heating cooker, which is capable of having the extremely wider width L of the heating chamber 1 to make it possible to a lot of cookings, of excellent cooking results of even toasting as double-face toasting, does not release (i.e., unignited) raw gas and superior safety in simpler construction.

A further object of the invention is to provide a gas combustion apparatus or a gas heating cooker, which has a gas burner lateral in the combustion blowing direction, an air blowing-off port disposed near the combustion flame port of the gas burner, and a blowing apparatus lateral in the blowing-off direction, so as to control the arrival position of the combustion hot air of the gas burner by the blowing-off air current of the blowing apparatus.

Still a further object of the invention is to provide a gas combustion apparatus or a gas heating cooker, which has burner tubes provided as gas burners in the opposite both-side positions, a supply portion for feeding the gas from one way and a heating flame port portion to integrally connect with each burner tube branched from the burner tube on both the sides, a fire transfer flame-port portion is provided to equalize the gas supply onto both the sides so as to make it possible to transfer the fire with the continuous combustion face.

Another object of the invention is to provide a gas heating cooker of double-face toasting operation, which has upper burners provided above the toasting net and lower burners provided on both the sides of the heating chamber under the toasting net, and blowing apparatuses provided near the lower burners so that combustion gas is guided to the central portion as hot current with the blast along the flames of the lower burner to effect the heating operation with uniform thermal distribution, the width of the heating chamber is superwidened enough to allow a large amount of cooking, the labor of turning over the food is unnecessary, and the food is toasted in shorter time and further with evenness.

Another object of the invention is to provide a gas combustion apparatus or a gas heating cooker, wherein a gas burner and a blowing apparatus are integrally engaged with by a burner member, a blowing member and a bulkhead so that the blowing operation is positively effected along the flame of the gas burner with compact construction, a burner tube which are integrally formed of a burner member, a blowing member, a bulkhead, the burner tube composed of the burner member, the bulkhead has a supply portion for feeding the gas, and a heating flame port portion provided oppositely on both the sides, and a fire-transfer flame-port portion integrally connected with burner tubes branched from the burner tubes on both the sides, furthermore an air tube formed of the blowing member and the bulkhead has a branch portion to the air entrance connecting at the central portion with the blower, and to both the sides, an air jetting portion opposite on both the sides, so that the uniform gas supply is effected onto both the sides of the gas burner, the flames may be positively transferred onto both the sides, also the air blowing is fed from the central portion by one unit blower and is uniformly branched onto both the sides so that the uniform thermal distribution may be provided to the central portion from both the right, left sides of the heating chamber.

Another object of the invention is to provide a gas combustion apparatus or a gas heating cooker, wherein an airflow-direction controlling member for regulating the airflow direction is disposed near the blowing apparatus so that the direction of the hot current is positively controlled to carry the heat current to the desired distant position when the blowing operation is effected to the flame of the gas burner, also the blowing-off direction of the blowing apparatus is adapted to have the blowing-off lower vector component from the horizontal direction so that the heat current may reach the farther distant position.

Another object of the invention is to provide a gas combustion apparatus or a gas heating cooker comprising an upper burner having a continuous combustion face which has its flame ports serially provided, a lower burner having a continuous combustion face which has a fire-transfer flame port portion and a heat flame-port portion serially provided into approximately U-shape, a firing burner which is confronted with the combustion face of the upper, lower burners, an electromagnet valve which turns on and off to feed the gas to the upper, lower firing fire burners, a firing detector is mounted on the firing burner to detect the existence of the ignition so as to provide a safe cooker, which positively effects the fire transfer into the upper, lower burners and does not release the raw gas through the go-out (blow-out) in the simplest construction.

Another object of the invention is to provide a cooker, whereby the blow amount of the blowing apparatus is controlled to provide much better heat distribution, and the full face of the superwide heating chamber is uniformly heated to remove the uneven toasting by a simple method of controlling the blow amount with the duty control through the on, off of the blowing machine.

Finally, still another object of the invention is to provide a cooker, wherein a heat shielding plate is detachably mounted under the toasting net provided in the heating chamber to make it possible to switch the oven function and the grill function to provide the wider use and to improve the convenience.

In accomplishing these and other objects, according to the embodiment of the present invention, a gas combustion apparatus, which has a gas burner for combusting, blowing off in the lateral direction, a blowing apparatus for blowing off in the lateral direction near the gas burner so as to control the arrival position of the combustion heat of the gas burner by the blow-off air current of the blowing apparatus. The gas heating cooker of the present invention, which is an applicaion of the apparatus, has upper burners above the toasting net of the heating chamber, lower burners on both the sides under the net, blowing apparatuses near the lower burners so as to blow along the flames of the lower burners by the blowing apparatus to guide the heat to the central portion of the wide heating chamber to effect the heating operation with uniform thermal distribution, furthermore as a pair of right, left burners of the upper and lower burners are formed of the continuous combustion face to make it possible to transfer the fire by the firing burners so that no raw gas is released because of the go-out, thus resulting in superior safety.

BRIEF DESCRIPTION OF THE DRAWINGS

These and other objects and features of the present invention will become clear from the following description taken in conjunction with the preferred embodiments thereof with reference to the accompanying drawings, in which:

FIG. 8(*b*) is a plan view of a bulkhead of the embodiment of FIG. 3;

FIG. 8(*c*) is a plan view of the blowing member of the exploded lower burner to be used in the gas heating member of the present invention shown in FIG. 3, and the exploded burner unit of the blowing apparatus;

FIG. 9(*b*) is a plan view of a combustion plate for the embodiment of FIG. 3;

FIG. 9(*c*) is a plan view of a burner upper plate of the exploded upper burner of the embodiment of FIG. 3;

DETAILED DESCRIPTION OF THE INVENTION

Figure 1:
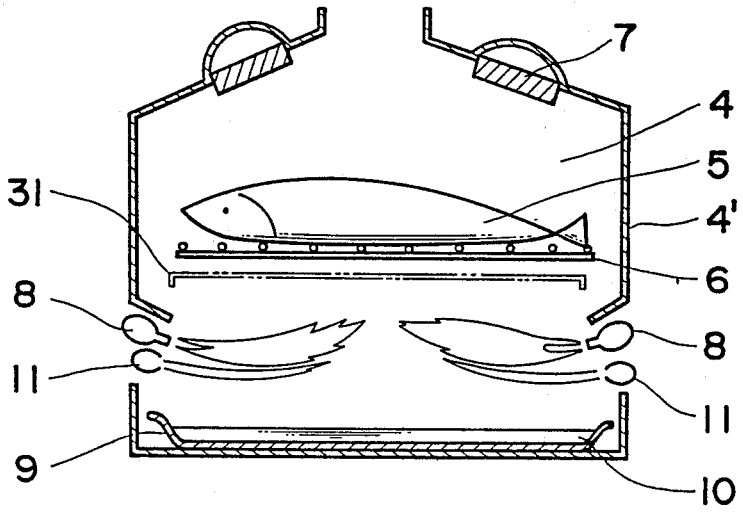
FIG. 1 is a front-face section view of a heating chamber of an applied gas heating cooker of a gas combustion apparatus in one embodiment of the present invention.

Before the description of the present invention proceeds, it is to be noted that like parts are designated by like reference numerals throughout the accompanying drawings.

Figure 2:
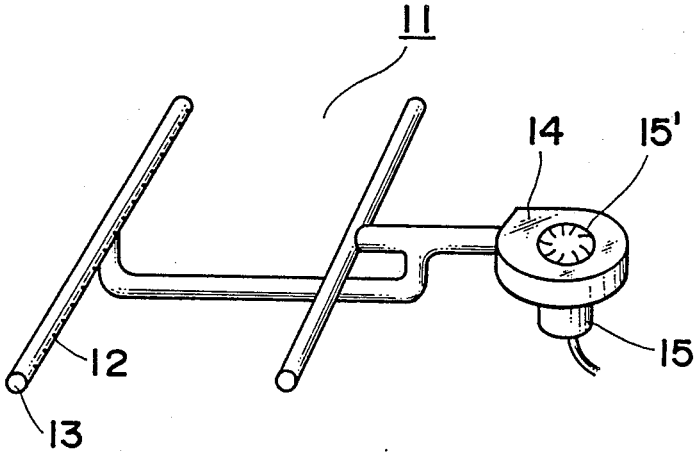
FIG. 2 is a perspective view of a blowing apparatus thereof.
Figure 14:
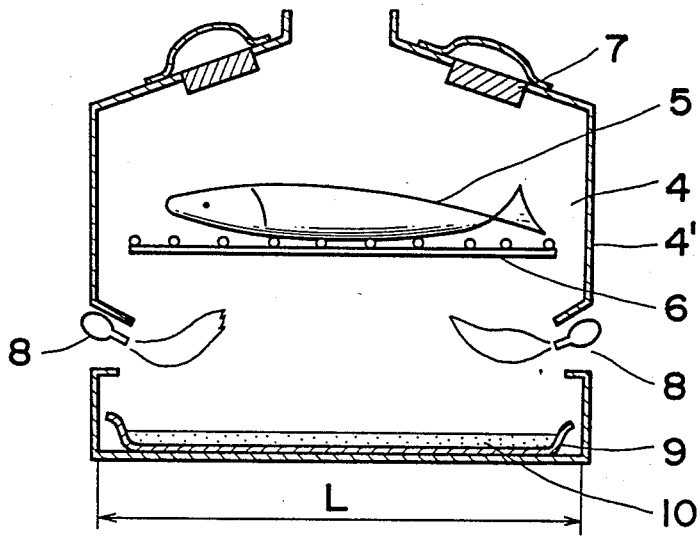
Fig. 14 PRIOR ART
FIG. 14 is a sectional view of the heating chamber of the conventional double-face toasting gas cooker.
Figure 15:
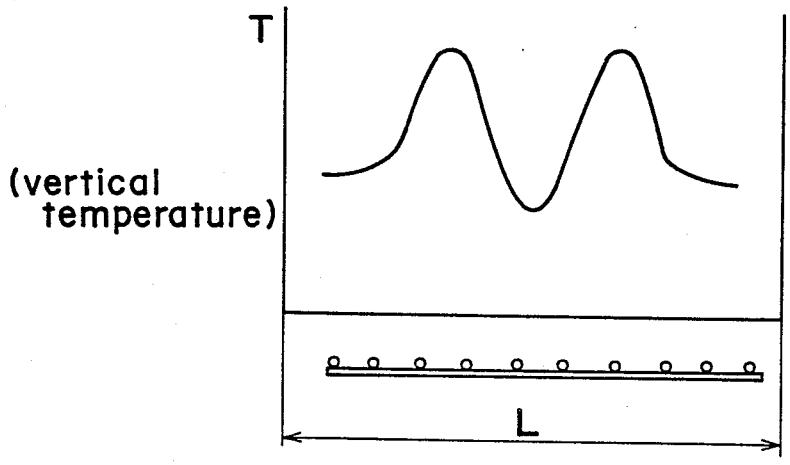
Fig. 15 PRIOR ART
FIG. 15 is a graph showing the temperature distribution of the convention toasting net portion of FIG. 14.
Figure 16:
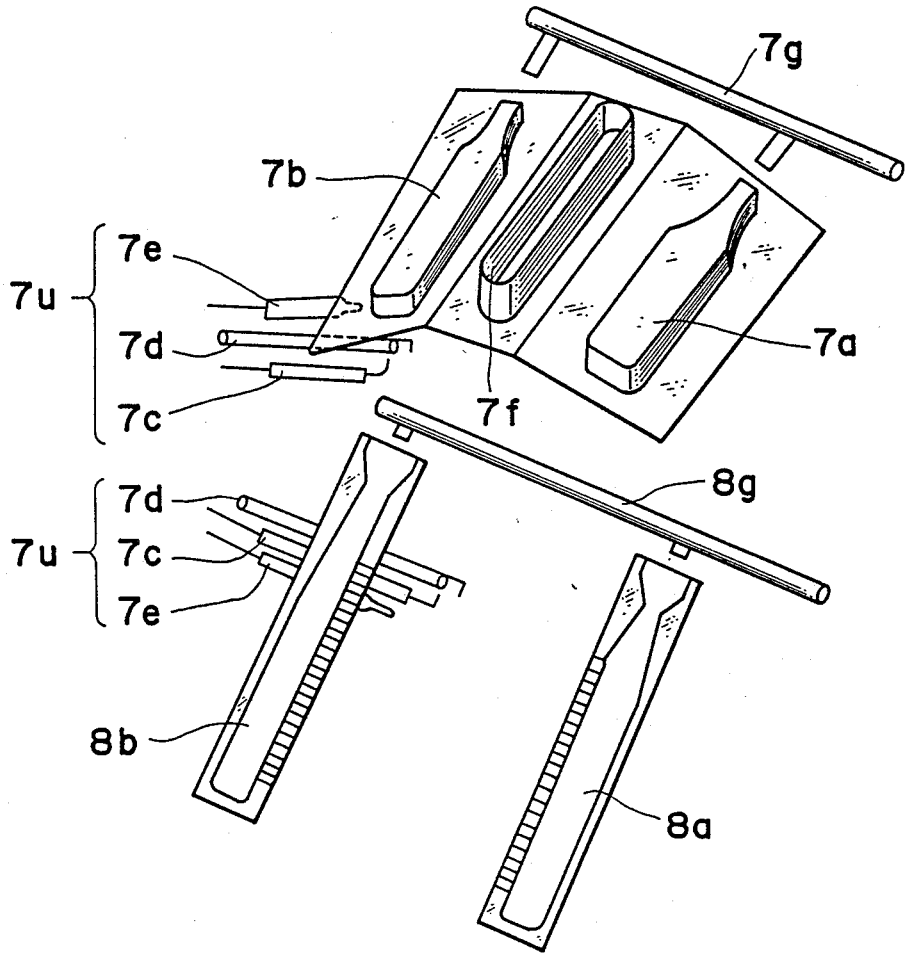
Fig. 16 PRIOR ART
FIG. 16 is a perspective view showing the construction of the conventional upper and lower burners.

The different point between FIG. 1 of the invention and FIG. 14 of the conventional device is that a blowing apparatus 11 is engaged on the lower portion of a lower burner 8. The blowing apparatus 11 blows, through the rotation of a fan blade 15' by a fan motor 15 which powers a blower 14, into a pipe 13 having numerous air exhaust ports 13 near the lower burner 8 as described in FIG. 2. The hot air of the lower burner 8 is carried to the desired far position by the air current blowing off in the horizontal direction from the blowing apparatus 11. Also, the lower vector component is put into the blowing air current to make it possible to carry the hot air much farther.

Figure 10:
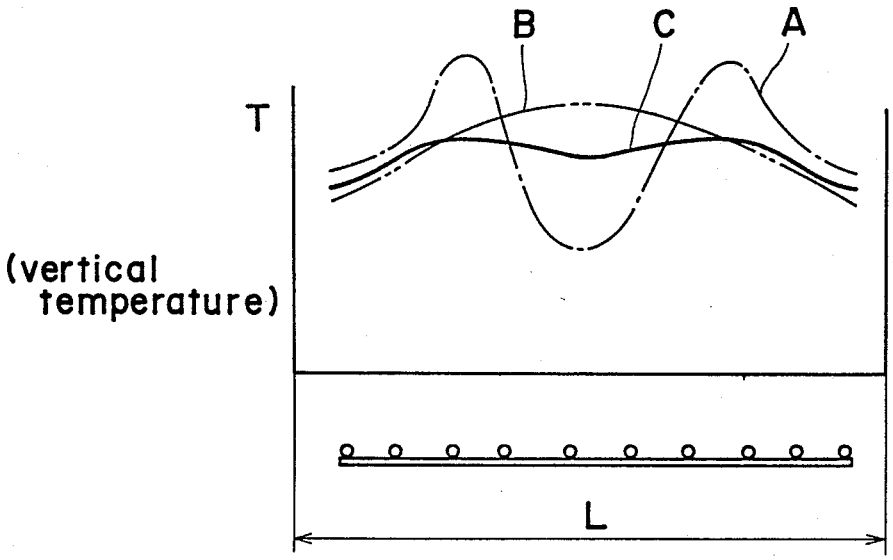
FIG. 10 is a graph showing the temperature distribution of the toasting net portion.

When the blowing apparatus 11 has been engaged with the upper portion of the lower burner 8, combustion gas is pushed so that it may come to the central portion of the heating chamber. When the blowing apparatus 11 has been engaged with the lower portion of the lower burner 8, the combustion gas is pulled so that it may be brought to the central portion. The thermal distribution in the toasting net 6 portion becomes approximately uniform as shown in FIG. 10 even above or below the lower burner 8. However, when the blowing apparatus 11 is mounted on the lower portion of the lower burner 8, the temperature of a stock saucer 9 is prevented from rising. Any fallen oil is not evaporated even if the saucer is not filled with water. Such oil is not burned. Conventionally, the water 10 filled in the saucer causes vapor to dampen the cooked food 5 and to deteriorate the taste. If the stock saucer 9 is filled with water 10, the temperature rise is less, with the same effect being provided. Also, when the blowing apparatus 11 is mounted in the upper portion of the lower burner 8, the rising air current of the combustion gas is efficiently controlled, so that the hot current may be positively controlled with less blow amount.

A gas heating cooker of the present invention will be described in another embodiment with reference to FIG. 3 through FIG. 9.

Figure 3:
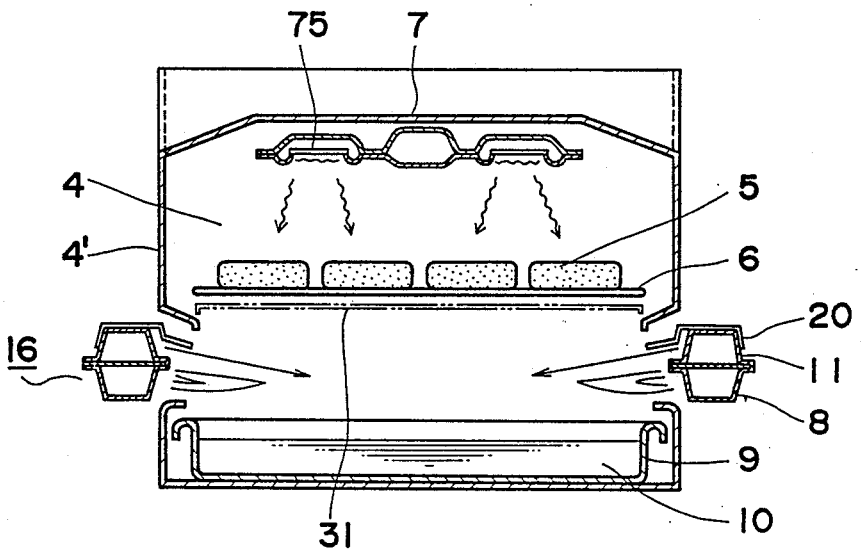
FIG. 3 is a front-face sectional view of a heating chamber of a gas heating cooker in the other embodiment of the present invention.
Figure 4:
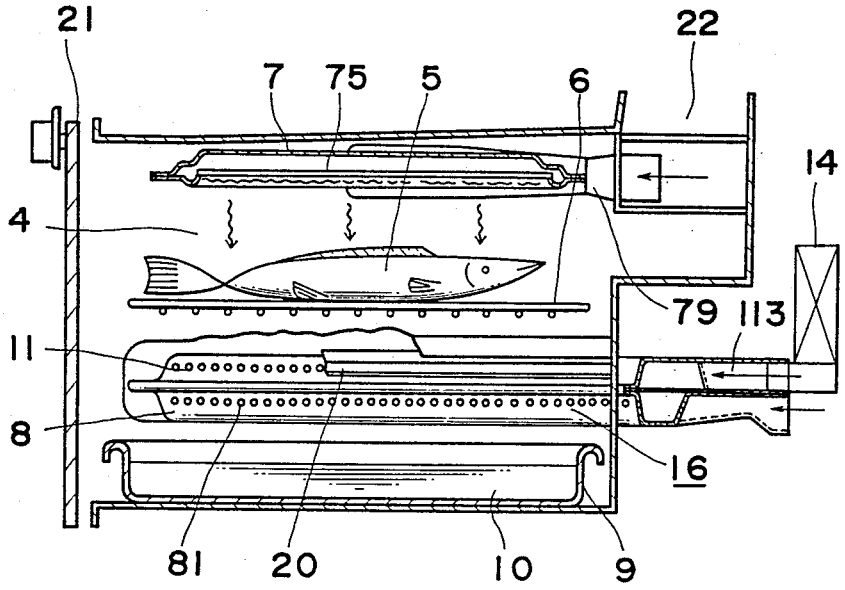
FIG. 4 is a side sectional view of FIG. 3.

The different in the embodiment FIG. 3 and FIG. 4 with respect to the first embodiment of FIG. 1 is that the lower burner 8 is integrally engaged with the blowing apparatus 11, with flame ports 75, 81 of the upper burner 7, the lower burner 8 being connected to provide a continuous combustion face.

Figure 5:
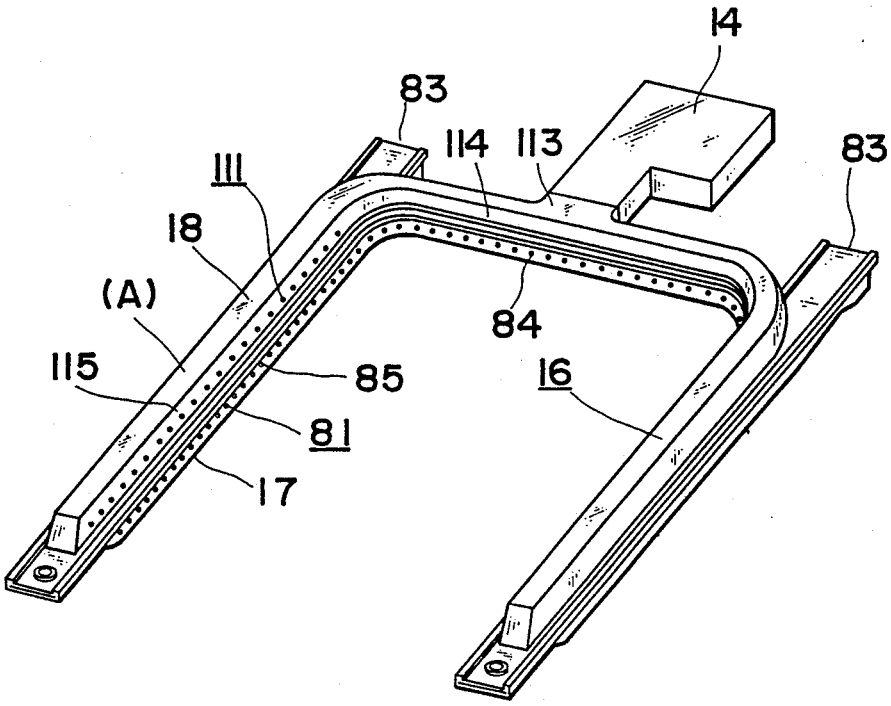
FIG. 5 is a perspective view of a burner unit integrated with a lower burner and a blowing apparatus in one embodiment of FIG. 3.
Figure 6:
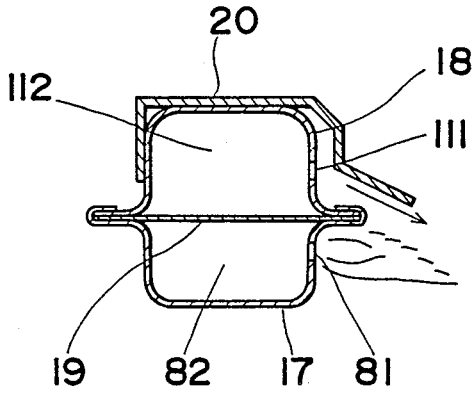
FIG. 6 is a partial sectional view in the A portion of a burner unit of FIG. 5.
Figures 8A, 8B, 8C, 9A, 9B, 9C:
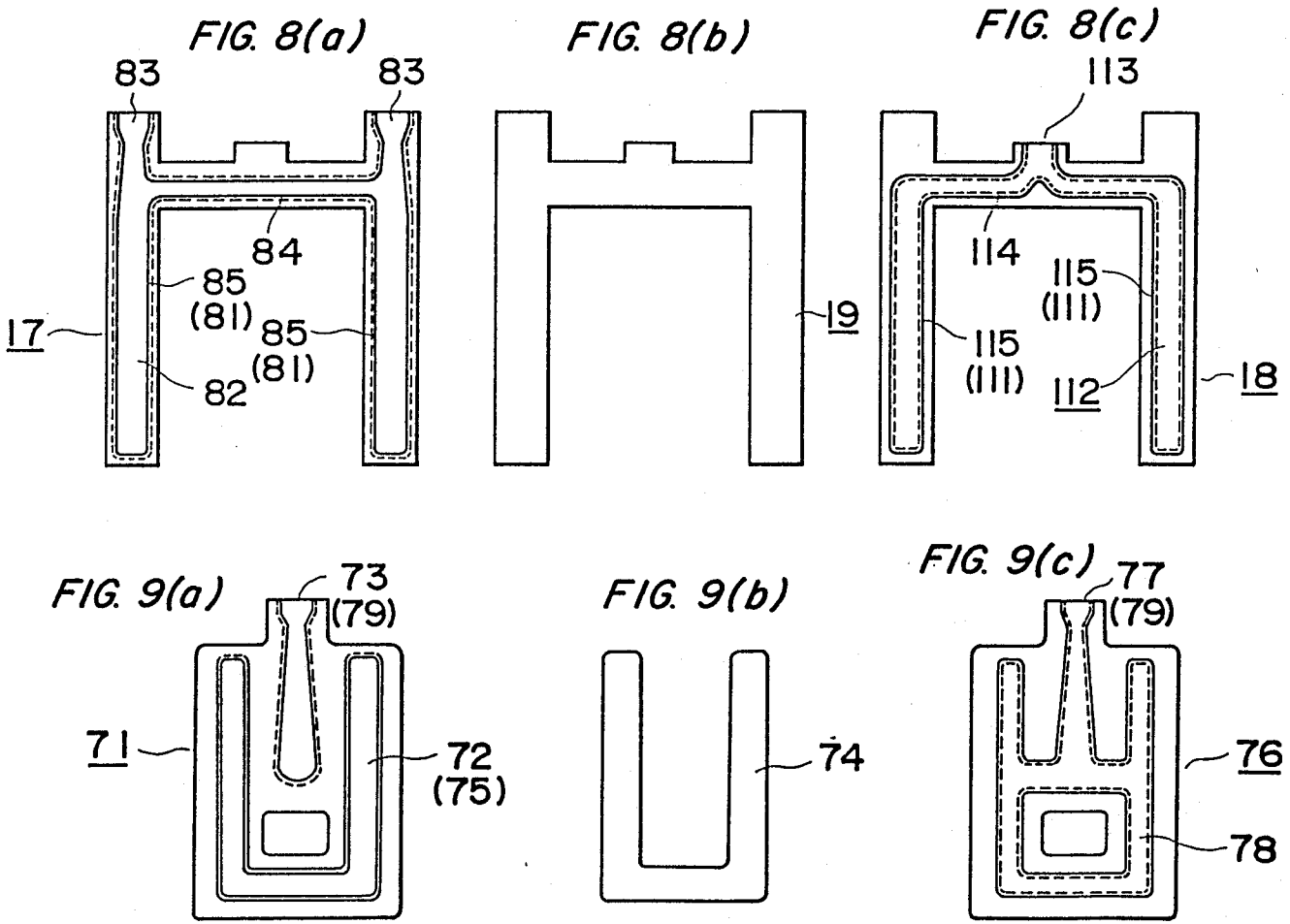
FIG. 8(*a*) is a plan view of the burner member of the embodiment of FIG. 3.
FIG. 9(*a*) is a plan view of the burner lower plate of the embodiment of FIG. 3.

A burner unit 16 having the lower burner 8 and the blowing apparatus 11 integrally engaged with is shown in detail in FIG. 5, FIG. 6, FIG. 8(*a*), FIG. 8(*b*) and FIG. 8(*c*). It is composed of a burner member 17 having numerous flame ports 81 arranged in one row or a plurality of rows, a blowing member 18 having numerous air exhaust ports 111 arranged in one row or a plurality of rows, and a bulkhead 19 for partitioning off between the burner member 17 and the blowing member 18. A tubular portion which is formed into an approximate H-shape with the burner member 17 and the bulkhead 19, with the burner member 17, the blowing member 18, the bulkhead 19 being formed in an approximate H-shape, is turned into a burner tube 82 into which fuel and primary air flows. A gas feed portion 83 having a gas entrance from one way and a mixing tube portion with the primary air sucked with the gas is provided at both the ends of the burner tube 82, a fire transfer flame-port portion 84 is provided at the center, and a heating flame-port portion 85 is provided on both the sides. The fire transfer flame portion 84 and the heating flame-port portion 85 make the continuous combustion flame. Also, a tubular portion which has been formed into an approximate U-shape with the blowing member 18 and the bulkhead 19 is turned into an air tube 112 with air being flown therein. An air entrance 113 which is coupled to the blowing machine 14, a branch portion 114 onto both the sides and an exhaust portion 115 having an air exhaust port 111 on both the sides are provided at the center of the air tube 112. A burner member 17, a blowing member 18, a bulkhead 19 are integrally engaged with caulking, or welding. The burner tube 82 and the air tube 112 are cut off by the bulkhead 19 respectively into an independent passage. An air flow direction controlling member 20 (not shown in FIG. 5) which is mounted on a blowing member 18 is adapted to regulate the air flow direction with respect to the flame of the lower burner 8 so that the resulting hot air current may positively reach farther.

Also, the similar effect is provided even at the upper portion and the lower portion when the blowing apparatus 11 of the burner unit 16 is provided near the lower burner 8 as described.

As shown in FIG. 9(*a*), FIG. 9(*b*), and FIG. 9(*c*), the upper burner 7 has a U-shaped opening 72 and a gas entrance 73, which become the combustion face, in the burner lower portion 71. The flame ports 75 with the combustion plate 74 composed of metal gauze, ceramic perforated plate or the like being mounted thereon, are formed to cover the opening 72. The burner upper plate 76 has a burner tube 78 mutually communicated with the gas entrance 77 and the combustion plate 74. The burner lower plate 71 is integrally fixed to the burner upper plate 76, a mixing tube 79 is formed of gas entrances 73, 77, with combustion plate 74 and the burner tube 78 forming the flame port 75 to make the continuous combustion face.

The front portion of the heating chamber 4 may be opened, closed by a door 21, with the rear upper portion of the heating chamber 4 becoming the exhaust port 22.

Figure 7:
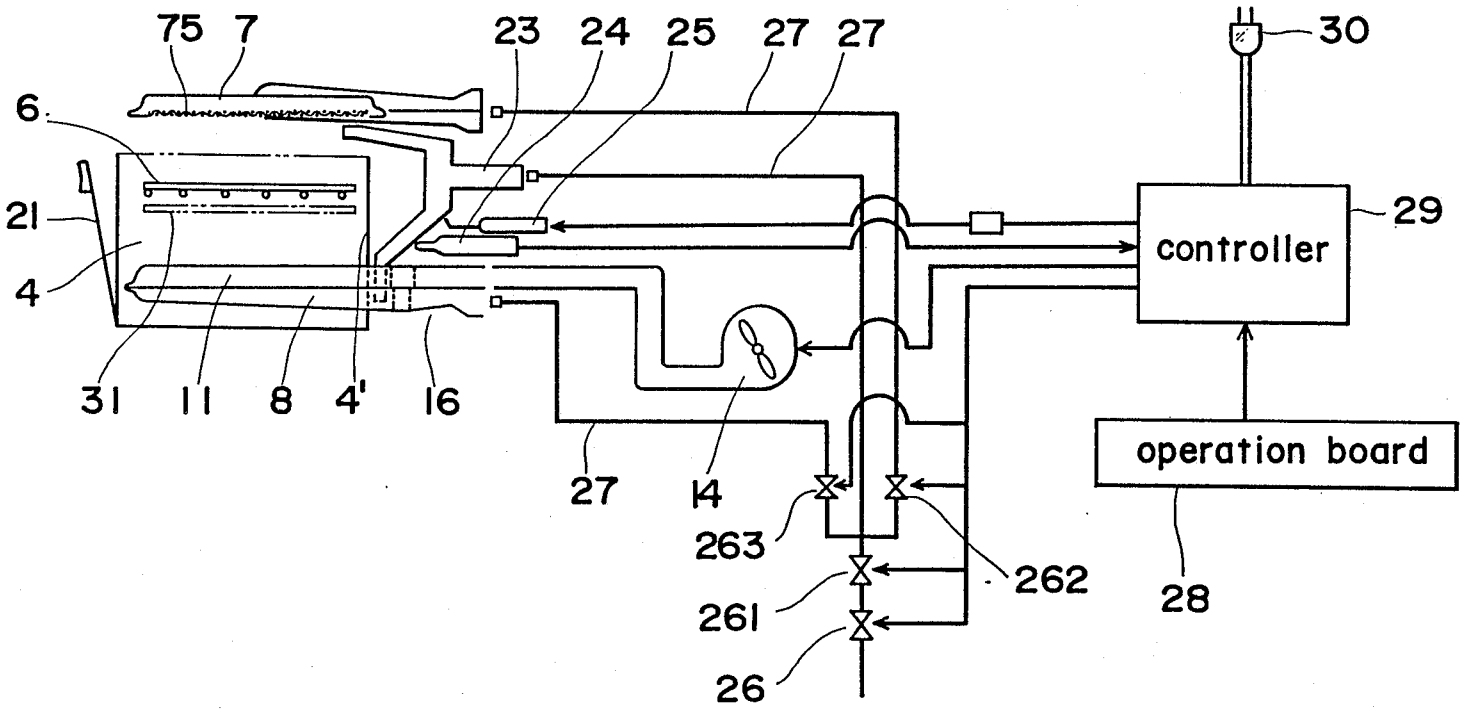
FIG. 7 is a system diagram showing the construction of a gas heating cooker in one embodiment of the present invention in FIG. 3.

FIG. 7 is a system diagram showing the construction of a gas heating cooker in one embodiment of the present invention. As described hereinabove, in a burner unit 16 integrally provided with the lower burner 8 and the blowing apparatus 11 as described hereinabove, the heat flame-port portion 85 of the lower burner 8 and the flame ports 81 of the fire transfer flame-port portion 84 form the continuous combustion face, furthermore the flame ports 75 from the continuous combustion face as in the upper burner 7, so that a pair of right, left burners of the upper, lower burners 7, 8 are constructed so that the fire may be transferred. A firing burner 23 is confronted with the combustion face of the upper burner 7, the lower burner 8 to ignite. A firing detector 24 to detect the existence of the ignition and an ignition plug 25 are engaged with the firing burner 23.

A blowing machine 14 is connected with the air entrance 113 of the blowing apparatus 11, an electromagnetic valve adapted to open or close the gas is provided on the upper, lower and the firing burners 7, 8, 23. The gas is fed from the gas tube 27 through the electromagnetic valves 261, 262, 263 corresponding to the respective burner from the main electromagnetic valve 26.

An operation portion 28 is adapted to select in advance and set the heating operation by the upper, lower burners 7, 8. The gas is inputted from the operation portion 28, the firing detector 24 by the controlling portion 29. It is outputted into the respective electromagnetic valves 26, 261, 262, 263, the blowing machine 14. A controlling portion 29 controls the gas heating cooker. Reference character 30 is a power supply.

When the size, shape, amount and so on of the food to be cooked 5 are varied, and further the applying operation is effected in the wide heating chamber 4, one can control the blow amount of the blowing apparatus 11 and much more effect is provided so that uniform heating which is better in thermal distribution is provided. The method of controlling the blow amount is as follows.

(1) Effect the duty control by the on/off of the blowing machine 14 with the heating of the central portion being increased during the blowing time, and the strong heating portion is moved from right to left, so that uniform heating is provided. In addition, methods of obtaining a similar effect ot that of (1) are as follows.

(2) Control for effecting the blowing operation from one way of the blowing apparatus 11 so as to effect the alternate operation.

(3) Control for pulsating the blow amount from maximum to minimum.

(4) Control for adjusting the wind-direction angle of the air flow direction control member 20. The better cooking results are provided even in any control method of the above description.

Figure 11:
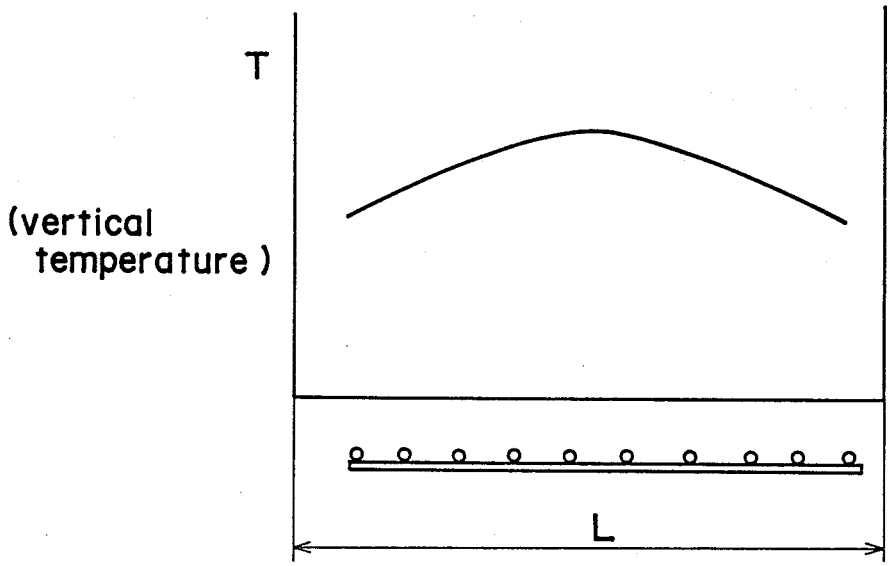
FIG. 11 is a graph showing the temperature distribution of a toasting net portion using a blowing apparatus with the duty control being effected likewise.
Figure 12:
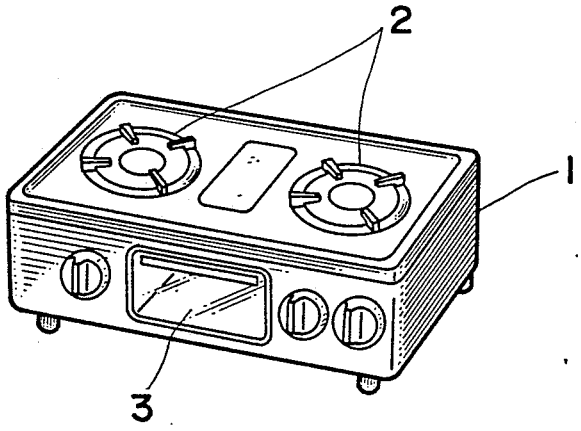
Fig. 12 PRIOR ART
FIG. 12 is a perspective view of the conventional gas range.
Figure 13:
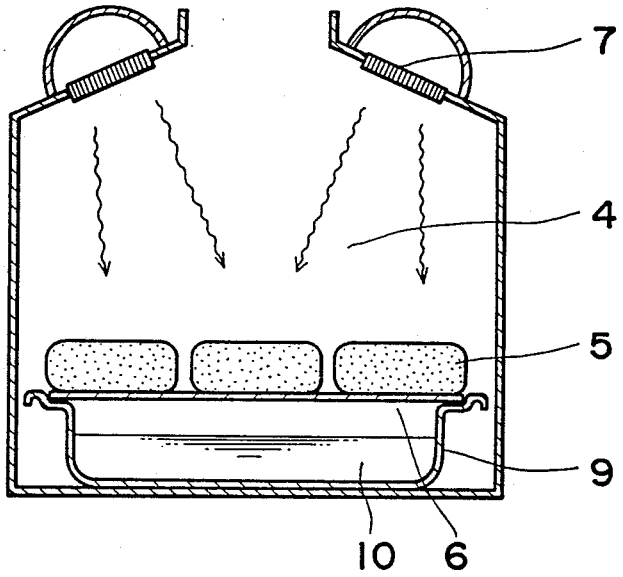
Fig. 13 PRIOR ART
FIG. 13 is a sectional view of the heating chamber of the conventional single-face toasting gas cooker.

FIG. 11 shows the temperature distribution of the toasting net 6 portion by the duty control of the above-described method (1). 15 seconds on condition of the blowing machine 14, and 5 seconds off condition are alternately repeated. One-dot chain line (A) of FIG. 10 shows the temperature distribution of the off condition in the blow machine, with two-dot chain line (B) of FIG. 10 being the on condition in the blowing machine 14. They are averaged, showing the temperature distribution of the solid line (C) of FIG. 10 as the result, so that uniform thermal distribution is provided.

A heat shielding plate 31 which is shown in FIG. 1, FIG. 3, and FIG. 7 is detachably mounted unde the toasting net 6 of the heating chamber 4. It is used for oven cooking when it is set, while it is for grill cooking when it is removed, so that the cooking use of the heating chamber is widened.

In the construction, the upper burner 7 and the lower burner 8 are ignited. Air flow which has horizontal or lower vector components is jetted along the flame directed from the air jetting ports 111 of the blowing apparatus 11 into the horizontal direction of the lower burner 8, so that hot current reaches as far as the lower central portion of the toasting net 6 to heat the entire face as uniform thermal distribution. At this time, simultaneous heating is effected on both the upper and lower faces of the food to be cooked 5 by the radiation heat by the combustion of the upper burner 7, so that a fast and even cooking property is ensured even in the superwide heating chamber 4.

The air flow direction is controlled by the air flow direction control member 20 near the blowing apparatus 11, the blow amount of the blowing apparatus 11 is controlled to sequentially move the strong heating portion, thus resulting in uniform thermal distribution and the superwidened heating chamber 4, which improves cooking effect.

As a firing burner 23 provided with a firing detector 24 is confronted with the upper burner 7, the lower burner 8 with a pair of right, left burners being formed with a continuous combustion face, the fire may be positively moved, so that the heating operation may be effected by a burner selected by the operation board 28, with risk of the raw gas being leaked because of the flame going out being prevented.

Also, as the heat shielding plate 31 is detachably mounted under the toasting net, a cooker which is wider in use application is achieved as it is used as an oven or grill.

As described hereinabove, the gas heating cooker of the present invention has the following effect.

1. The width of the heating chamber may be made superwide, the toasting-net lower portion may be heated with uniform thermal distribution to provide a superior cooking property with even toasting. In addition, the design freedom-degree is superior as a cooker in that uniform thermal distribution is provided if the height of the heating chamber is small.
2. As the heating operation is effected with uniform thermal distribution from both the faces of the cooked by the upper, lower burners, the conventional uneven heating is removed. The bother of turning over is saved during the cooking operation, and the cooking time may be made faster. Also, as the cooked food is not required to be turned over, it is not attached to the toasting net. It is kept in good shape.
3. The flame may be positively transferred to the upper, lower burners by the firing burner, so that any risk of leaking the raw gas because of the flame go-out as before is completely removed, with better safety being provided. The easier manufacturing operation is effected with simpler construction by the minimum ignition units of the upper, lower burners.
4. As the cooker may be used as a grill or oven through the detachment of the heat shieling plate, its use becomes wider and more useful in cooking.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A gas combustion apparatus comprising:

a first lower gas burner means for burning a gas supplied thereto, said lower gas burner means including a pair of first and second spaced opposed burner tubes, each one of said pair of first and second spaced opposed burner tubes having a plurality of flame ports defined therein, each one of said plurality of flame ports having means for directing a flame fueled by a gas and originating at said each one of said plurality of flame ports in said first one of said pair of first and second spaced opposed burner tubes substantially horizontally and toward the plurality of flame ports in said second one of said pair of first and second spaced opposed burner tubes for defining a heating region between said pair of first and second spaced opposed burner tubes;

air supply means adjacent to said pair of first and second burner tubes for supplying an air flow adjacent to flames originating at each one of said plurality of flame ports, said air supply means including orifice means for directing the air flow substantially horizontally and adjacent to the substantially horizontal flames originating at each one of said plurality of flame ports for elongating the horizontal length of the flames and for controlling the location of the outermost ends of the flames for further defining the extent of said heating region between said pair of first and second spaced opposed burner tubes;

fire transfer means located between said first and said second ones of said pair of spaced opposed burner tubes for transferring a flame fueled by gas from a first one to a second one of said pair of burner tubes for igniting flames fueled by gas at each one of said plurality of flame ports of both ones of said pair of first and second spaced opposed burner tubes when the plurality of flame ports of at least one of said pair of burner tubes is ignited;

means for unifying said first lower gas burner means, said air supply means, and said fire transfer means into an integral combination;

a second upper gas burner means for burning a gas supplied thereto, and said upper gas burner means being vertically spaced above said lower gas burner means;

a firing burner located between said lower gas burner means and said upper gas burner means for transferring a flame fueled by gas from one of said lower and upper gas burner means to the other one of said lower and upper gas burner means and for causing at least one of said lower and upper gas burner means to always be ignited to prevent release of any unignited gas; and support means disposed between said first lower gas burner means and said second upper gas burner means for supporting an object to be heated within or adjacent to said heating region between said pair of first and second burner tubes and further defined by the flames originating at said plurality of flame ports and elongated and controlled in location by said orifice means of said air supply means.

2. A device as in claim 1, wherein said orifice means of said air supply means is vertically spaced from and disposed above said plurality of flame ports of said first lower burner means and below said second upper burner means.

3. A device as in claim 1, wherein said orifice means of said air supply means is vertically spaced from and disposed below said plurality of flame ports of said first lower burner means.

4. A device as in claim 1, further comprising a firing detector disposed adjacent to said firing burner for detecting the presence of an ignited state of gas, an electromagnetic valve for regulating the flow of gas to said first lower gas burner means, to said second upper gas burner means, and to said firing burner, and a control means for controlling and operating said electromagnetic gas valve, said firing detector, and said upper and lower gas burner means.

5. A device as in claim 2, further comprising a firing detector disposed adjacent to said firing burner for detecting the presence of an ignited state of gas, an electromagnetic valve for regulating the flow of gas to said first lower gas burner means, to said second upper gas burner means, and to said firing burner, and a control means for controlling and operating said electromagnetic gas valve, said firing detector, and said upper and lower gas burner means.

6. A device as in claim 3, further comprising a firing detector disposed adjacent to said firing burner for detecting the presence of an ignited state of gas, an electromagnetic valve for regulating the flow of gas to said first lower gas burner means, to said second upper gas burner means, and to said firing burner, and a control means for controlling and operating said electromagnetic gas valve, said firing detector, and said upper and lower gas burner means.

* * * * *